United States Patent [19]

Fahim et al.

[11] 4,286,563

[45] Sep. 1, 1981

[54] FUEL RAIL FOR AN ENGINE

[75] Inventors: Magdi M. Fahim, Rochester; Victor J. Nowak, Royal Oak; Nagui R. Matta, Huntington Woods, all of Mich.

[73] Assignee: The Bendix Corporation, Southfield, Mich.

[21] Appl. No.: 21,663

[22] Filed: Mar. 19, 1979

[51] Int. Cl.[3] ..... F02M 55/00; B02B 1/14

[52] U.S. Cl. ..... 123/469; 239/550; 239/587

[58] Field of Search ..... 123/139 AW, 119 R, 32 AE, 123/32 EA, 148 A, 468–470; 239/549–551, 568, 585, 587, 600; 4/145, 150, 152, 181, 596, 601, 615

[56] References Cited

U.S. PATENT DOCUMENTS

| | | | |
|---|---|---|---|
| 1,484,575 | 2/1924 | Shulin | 239/550 X |
| 2,148,419 | 2/1939 | Parker et al. | 239/550 X |
| 2,776,168 | 1/1957 | Schweda | 4/145 X |
| 3,412,718 | 11/1968 | Long | 123/32 AE |
| 3,776,209 | 12/1973 | Wertheimer | 123/119 R |
| 3,783,844 | 1/1974 | Gural | 123/139 AW X |
| 3,887,136 | 6/1975 | Anderson | 239/587 X |
| 3,930,483 | 1/1976 | Blisko et al. | 123/119 R X |
| 3,980,058 | 9/1976 | Nakagawa et al. | 123/32 AE X |
| 4,030,668 | 6/1977 | Kiwior | 239/568 X |
| 4,143,625 | 3/1979 | Kulke | 123/139 AW X |

FOREIGN PATENT DOCUMENTS

| | | | |
|---|---|---|---|
| 1022837 | 1/1958 | Fed. Rep. of Germany | 239/550 |

OTHER PUBLICATIONS

"Brain Controls Fuel-Injection System," by A. H. Winkler et al., SAE Journal, Apr. 1957.

*Primary Examiner*—Stuart S. Levy

*Attorney, Agent, or Firm*—Markell Seitzman; Russel C. Wells

[57] ABSTRACT

A fuel rail of unitary construction for supplying fuel to a plurality of fuel injectors in an engine such as a V-8 engine. The fuel rail contains a plurality of connectors, one for each injector. Each connector is fitted with an one for each injector. Each connector is fitted with an O-ring to provide a liquid tight seal between the connector and each injector. The connector and O-ring are so sized to permit the connector to swivelably engage each injector permitting the injector to rotate in a conical fashion about an axis through the center of the connector.

3 Claims, 6 Drawing Figures

FUEL RAIL FOR AN ENGINE

BACKGROUND AND SUMMARY OF THE INVENTION

This invention relates to fuel rails and mounting arrangements for fuel injectors for internal combustion engine fuel injection systems. More particularly, the invention relates to a single piece fuel rail for supplying fuel to a plurality of fuel injectors.

Injectors are typically inserted into bores in the intake manifold of an engine. The mounting geometry of the injector relative to the intake manifold varies from engine to engine. As an example, it may be a requirement of an engine fuel system that the injector extend perpendicularly away from the intake manifold or extend at a determinable angle from the intake manifold. Furthermore, each injector in its mounted position may be skewed relative to any other injector. U.S. Pat. No. 3,776,209 to Wertheimer et al., issued Dec. 4, 1973, and U.S. Pat. No. 3,930,483 to Blisko et al., issued Jan. 6, 1976, illustrate common features of fuel rail designs. As can be appreciated because of the varied mounting orientations of each injector relative to one another, it may be necessary to use a plurality of clamps or flexible hoses to achieve proper fuel distribution by attaching each injector to its respective fuel carrying conduit as shown in U.S. Pat. No. 3,930,483. Alternatively, U.S. Pat. No. 3,776,209 shows the use of a fuel rail comprising two rigid conduits linked by two threaded connectors. Because of the angular orientation of each injector, the fuel rail must be assembled by joining both conduits using the threaded fittings after each bank of injectors are seated in the intake manifold and their respective conduit.

The advantages of the one piece fuel rail of the present invention are that it is easier to handle, takes less time to insert the injectors into the intake manifold and requires no assembly. In addition, the unitary construction increases reliability by eliminating threaded plumbing fittings and compliant rubber hoses while also lowering the cost of fuel rail.

The present invention relates to a fuel rail which is adapted to receive a plurality of fuel injectors and a mounting arrangement for injectors of an engine including a V-4, V-6, or V-8 engine. According to the embodiment of this invention, as illustrated in the drawings of this application and discussed in detail below, the fuel rail is a fuel carrying member for supplying pressurized fuel to injectors of a fuel injected engine. The fuel rail comprises a connector, one associated with each injector, adapted to rotatably receive each injector. The connector, which is in itself a fluid carrying member, comprising a cup-like structure having a shoulder therein to receive a resilient O-ring. The coaction of the connector, O-ring, and injector therein establishing a fluid type seal while affording an additional degree of freedom to permit the injector to be rotatably oriented in a conical fashion about an axis through the center of the connector to permit the simultaneous seating of all the injectors into the engine.

It is an object of the present invention to provide a rigid fuel rail of unitary construction for an engine. Many other objects and purposes of the invention will be clear from the following detailed description of the drawings.

DETAILED DESCRIPTION OF THE DRAWINGS

Figure 1:
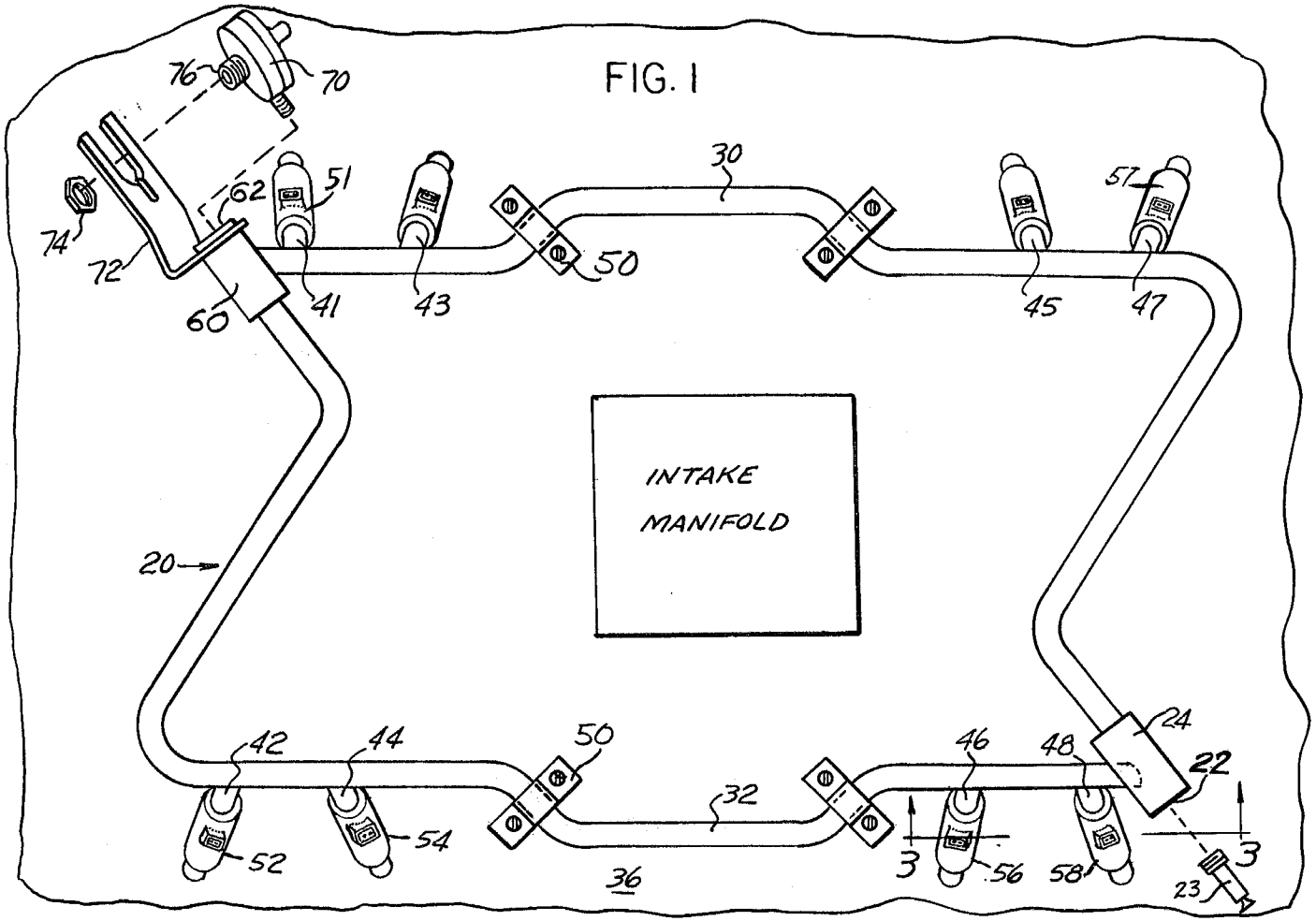
FIG. 1 is a top view of the fuel rail injector installation for a V-8 engine.

Reference is made to Fig. 1 which shows a top view of the fuel rail 20 of the present invention. The fuel rail 20 consists of a plurality of interconnected conduits adapted to connect to a fuel line 23 delivering a pressurized quantity of fuel from a pump (which is not shown). Fuel is received from the pipe line 23 by receiving means such as a Y-connection 24 having an inlet 22. The received fuel is distributed to the tubular fluid carrying conduits 30 and 32. Each fluid carrying conduit (30,32) supplies pressurized fuel to the injectors. In the embodiment shown in FIG. 1, the fuel rail is designed to carry fuel to a V-8 engine having two banks of four injectors in each bank. The odd numbered injectors 51, 53, 55, and 57 are shown interconnecting the engine 36 with conduit 30. In addition, a plurality of connectors 41, 43, 45 and 47 are shown in fluid communication with conduit 30. These connectors (41–47) interconnect the injectors 51 through 57 to the conduit 30. Similarly, a plurality of even numbered injectors 52, 54, 56 and 58 are connected to conduit 32 by a plurality of fluid carrying connectors (42,44,46, and 48). Conduits 30 and 32 are joined by a connector 60 such as a second Y-connector. The connector 60 therein forms the outlet end 62 of the fuel rail 20. The connector 60 is adapted to receive a pressure regulator 70. In the embodiment shown in FIG. 1, the pressure regulator 70 is threadably received within by connector 60. In addition, the pressure regulator 70 is secured to the fuel rail 20 by a bracket 72 and a threaded nut 74 which engages the output 76 of the regulator 70.

Many fuel injection systems require a continuous flow of fuel within its fluid carrying conduits. Consequently, many applications require a return tube connecting the output 76 of the regulator 70 to the fuel tank (not shown).

Figure 2:
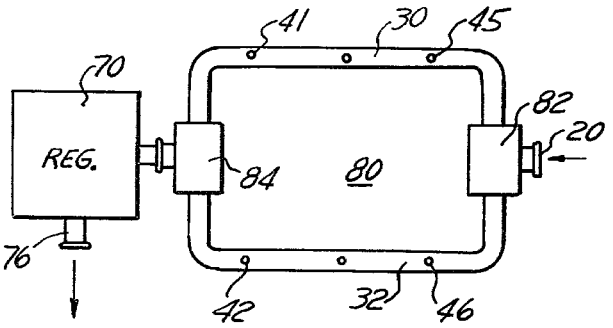
FIG. 2 is an alternate embodiment of the fuel rail shown in FIG. 1.

Reference is made to FIG. 2 which shows an alternate configuration of the fuel rail 20. More particularly, there is shown a fuel rail 80 containing a plurality of connectors 41 through 46 arranged in two equal and symmetric arrays and adapted to receive injectors 51 through 56 (not shown). To achieve symmetric flow, the fuel rail 80 utilizes two T-connectors 82, 84 symmetrically linking conduits 30 and 32. In addition, it should be noted that fuel rail 80 contains only six connectors 41 through 46. This is to illustrate the applicability of the present invention to engines having other than eight injectors. It should be appreciated that the precise shape of the fuel rail is not a requirement of the present invention and will vary with the placement of the injectors on the engine.

Figure 3:
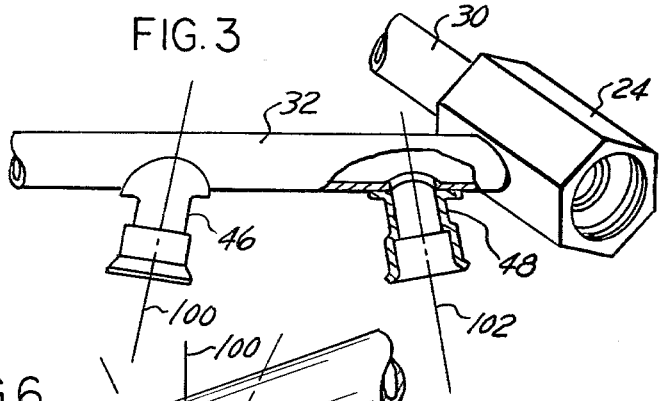
FIG. 3 is a side view showing with more particularity the relationship between the fuel rail and its connectors.

Reference is now made to FIG. 3 which shows in more detail the interrelationship between the connector 24, conduits 30, 32, and the connectors 41–48, and in particular, connectors 46 and 48. It should be noted that in general any two connectors, such as connectors 46 and 48, may have their central axes 100 and 102 skewed relative to each other. The precise angle of skewing between each connector is determined from the mounting relationship of the injectors relative to the engine and the spacing between the fuel rail 20 and the engine 36. The angle may also be a function of the size of the connectors and the length and mounting and other geometries of the injectors. Furthermore, one skilled in the art will appreciate the fact that heretofore it has been impossible because of the skew mounting of injectors to simultaneously seat each injector into the engine 36 and to the fuel rail 20. This problem in part is due to the previously mentioned skewed mounting of the injectors to the engines as well as to the tight tolerances used in connecting the fuel rail 20 to the inlet portions of each injector. In the preferred embodiment of the invention, the conduits 30 and 32 are fabricated from cylindrical metal tubes having a determinable inside diameter. The diameter is sized upon the injector flow requirements of the fuel system. To reduce the costs of the preferred embodiment, it is visualized that each connector 41 through 48 is to be fabricated using a stamped connector which is later attached including being welded to the appropriate conduit. The features of the stamped connector are shown with more particularity in FIGS. 4 and 5.

Figure 5:
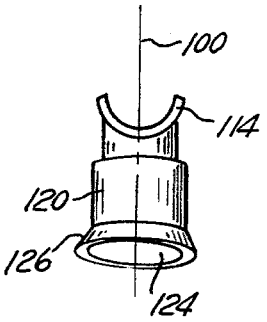
FIG. 5 is a side view through Section 5 of FIG. 4.
Figure 4:
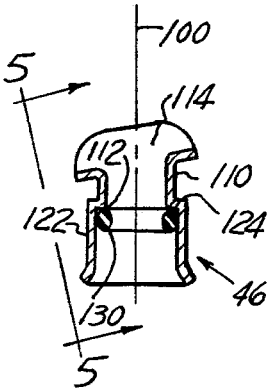
FIG. 4 is a sectional view of a particular connector.

FIG. 4 is an isolated view of the connector shown in FIG. 3 while FIG. 5 is a side-view of the connector shown in FIG. 4. The connector such as connector 46 consists of a symmetric hollow member having a central axis such as axis 100. Each connector contains a pipe-like member 110 having inner walls which are coaxial to the central axis 100. The pipe-like member 110 contains a first end 112 and a base end 114. In the preferred embodiment each connector is to be connected to a circular, tubular member such as conduit 30 and the base end 114 reflects the required circular cross section for attachment thereon (FIG. 5). In addition, the base end 114 is so adapted relative to the central axis of the connector so that when the connector 46 is attached to the conduit 32 the central axis 100 of the connector is maintained at the required angle for mounting each injector to the engine. In addition, the connector 46 contains a cup-like member 120 having a base end 122 and an open end 124. The base end 122 is so mated to the first end 112 so as to form a shoulder 124 about the central axis 100. In addition, to faciliate injector mounting the open end 124 can be fabricated with an outgoing flare 126 and fitted with a resilient sealing means such as O-ring 130.

Figure 6:
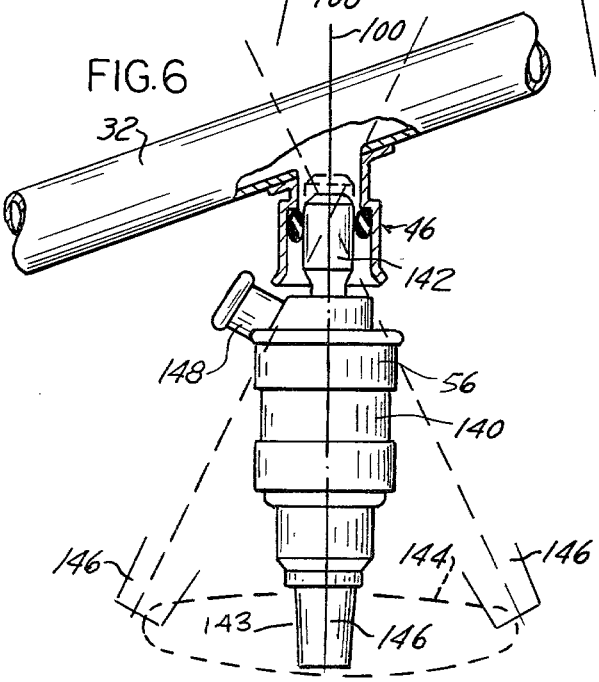
FIG. 6 shows the mounting relationship between the fuel rail, connector, and injector.

Consider now an injector such as the injector 56 shown in mounted relationship to its associated connector 46 as illustrated in FIG. 6. The injector is shown in full view while a sectional view of connector 46 is shown. The injector 56 is a typical injector as used in fuel injection systems, such as the injector illustrated in U.S. Pat. No. 4,030,668 to Kiwior which issued on June 21, 1977 and which is expressly incorporated by reference. The injector comprises a body 140, an inlet conduit 142, and an outlet conduit 143, typically containing a pintel protected by a plastic shield 146. Command signals are input from a control unit (not shown) to the injector 56 through an electrical connector 148.

Consider now the relationship between the exterior of the inlet conduit 142 and the interior of connector 46 after insertion of the injector 56 into the open end 124 of the connector 46. The inner diameter of the pipe-like member 110 is sized to loosely receive the inlet conduit 142. Further insertion of the inlet conduit 142 into the connector 46 causes compressing the O-ring 130 against the inner wall of the cup-like member 120 as well as against the shoulder 124 thereby establishing a fluid tight seal between the injector 56 and the connector 46. In this manner by oversizing the inner diameter of the cup-like member 120 relative to the body 140, it is now possible to move the injector 56 in a conical fashion 144 about the central axis 100 as illustrated in FIG. 6.

In addition, as can be seen from FIG. 6, the O-ring 46 also permits the injector 56 to be slideably received within the connector 46, i.e., the injector 56 can slide parallel to the central axis 100 relative to the O-ring.

Consider now the procedure which would be used by an assembler during the mounting of the plurality of injectors to the fluid rail 20 and then to the engine 36. Each injector would first be inserted into its corresponding connector. The interaction of the O-rings and the injectors will permit each injector to remain moveably yet securely fastened to the fuel rail 20. The fuel rail 20 in combination with a full complement of injectors can be moved to the engine 36. The fluid rail 20 can then be held in spaced relationship over the intake manifold of the engine 36 wherein the fluid rail 20 and injectors will then be lowered so that each injector is proximate its respective mounting hole within the engine. Each injector is then moved until it is coaxial with the center of its respective mounting hole. At this point the entire fuel rail/injector combination is lowered therein simultaneously seating all eight injectors within a seal such as another set of O-rings fitted to each mounting hole. The fuel rail is then permanently secured to the engine by mounting brackets 50 (FIG. 1) therein completing the mounting process.

Many changes and modifications in the above-described embodiments of the invention can, of course, be carried out without departing from the scope thereof. Accordingly, that scope is intended to be limited only to the breadth of the appended claims.

We claim:

1. An apparatus for delivering fuel to at least one fuel injector of an engine comprising:

fuel rail means of unitary construction including a fuel carrying conduit for receiving fuel input thereto and for distributing the fuel to the at least one injector;

a connector affixed directly to and in fluid communication with said fuel rail means and the at least one fuel injector, one associated with each injector having receiving means for telescopically and swivelably receiving a portion of the at least one injector and attachment means for connecting said receiving means to said fuel rail means;

said receiving means including a base end having a passage therein, rigidly affixed to said fuel rail means, an open end opposite thereto and a wall joining said base end to said open end, said receiving means further incuding an o-ring adapted to seat upon said base end, wherein said wall is sized to loosely receive an end of the at least one injector and wherein said o-ring provides a fluid tight seal between said wall and the received end of the at least one injector and provides a vertex for permitting the pivoting motion of the at least one injector relative to said wall.

2. An apparatus for delivering fuel to a plurality of fuel injectors of an engine arranged in a determinable pattern on the engine, the apparatus comprising:

fuel rail means, of unitary construction includng a conduit for receiving fuel input thereto and for distributing the fuel to each injector;

a connector affixed directly to and in fluid communication with said fuel rail means, one associated with each connector, having receiving means for telescopically and swivelably receiving a portion of each injector and attachment means for connecting each of said receiving means to said fluid rail means;

said receiving means including a base end having a passage therein, rigidly affixed to said fuel rail means, an open end opposite thereto and a wall joining said base end to said open end, said receiving means further including an o-ring adapted to seat upon said base end, wherein said wall is sized to loosely receive an end of the at least one injector and wherein said o-ring provides a fluid tight seal between said wall and the received end of the at least one injector and provides a vertex for permitting the pivoting motion of the at least one injector relative to said wall.

3. A fuel delivery system for an internal combustion engine, the engine having at least two rows of spaced fuel injection ports, wherein each injection port is adapted to receive an interfitting portion of a fuel injector; the system comprising:

a fuel injector adapted at one end to engage one of said fuel injection ports and adapted at its other end to engage a resilient sealing means;

a fuel carrying member of unitary construction having an inlet end adapted to receive fuel and an outlet end, and further having a plurality of fuel carrying conduits in fluid communication with said inlet and said outlet ends, and wherein said fuel carrying conduits are arranged to substantially conform to the placement of each row of fuel injection ports on the engine;

a connector, one associated with each injector, comprising:

a hollow cup like member having a base end, rigidly connected in fluid communication, to said member, and further having a circumferential wall connected to said base end, providing, at one end, in cooperation with said base end, a shoulder and providing at another end an opening to loosely receive an end of an injector; said connectors located along said conduits such that, upon assembly the central axis of said circumferential wall, the longitudinal axis of the injector and the center of the corresponding fuel injection port are colinearly aligned;

resilient sealing means, located upon said shoulder for providing a fluid-tight seal between said cup-like member and the injector; and wherein said walls, shoulder and resilient sealing means provide a means for telescopically receiving the injector and means for swivelably engaging the injector to permit the injector to be moved relative to said resilient sealing means wherein said resilient sealing means provide a vertex for the motion of the injector.

* * * * *